US011435093B2

(12) United States Patent
Xue et al.

(10) Patent No.: US 11,435,093 B2
(45) Date of Patent: Sep. 6, 2022

(54) AIR-CONDITIONING OUTDOOR DEVICE AND AIR CONDITIONER UNIT

(71) Applicants: Gree Electric Appliances (Wuhan) Co., Ltd., Wuhan (CN); Gree Electric Appliances, Inc. of Zhuhai, Zhuhai (CN)

(72) Inventors: Handong Xue, Zhuhai (CN); Youfu Xie, Zhuhai (CN); Kai Yu, Zhuhai (CN); Lin Yang, Zhuhai (CN); Hui Zhang, Zhuhai (CN); Chaosheng Deng, Zhuhai (CN); Yaguo Zhang, Zhuhai (CN)

(73) Assignees: Gree Electric Appliances (Wuhan) Co., Ltd., Hubei (CN); Gree Electric Appliances, Inc. of Zhuhai, Guangdong (CN)

( * ) Notice: Subject to any disclaimer, the term of this patent is extended or adjusted under 35 U.S.C. 154(b) by 525 days.

(21) Appl. No.: 15/766,102

(22) PCT Filed: Mar. 8, 2018

(86) PCT No.: PCT/CN2018/078421
§ 371 (c)(1),
(2) Date: Apr. 5, 2018

(87) PCT Pub. No.: WO2019/127906
PCT Pub. Date: Jul. 4, 2019

(65) Prior Publication Data

US 2019/0195516 A1 Jun. 27, 2019

(30) Foreign Application Priority Data

Dec. 26, 2017 (CN) ..... 201711431265.7

(51) Int. Cl.
*F24F 1/52* (2011.01)
*F24F 1/62* (2011.01)
(Continued)

(52) U.S. Cl.
CPC ..... *F24F 1/52* (2013.01); *F24F 1/16* (2013.01); *F24F 1/38* (2013.01); *F24F 1/62* (2013.01); *F24F 1/40* (2013.01)

(58) Field of Classification Search
CPC ..... F24F 1/52; F24F 1/62; F24F 1/38; F24F 1/16; F24F 1/40
See application file for complete search history.

(56) References Cited

U.S. PATENT DOCUMENTS 2,717,508 A * 9/1955 Loveley ..... F24F 1/027 62/262
3,040,544 A * 6/1962 Atchison ..... F24F 11/84 62/262
(Continued)

FOREIGN PATENT DOCUMENTS

CN 2388528 Y 7/2000
CN 2744965 Y 12/2005
(Continued)

OTHER PUBLICATIONS

English Translation of CN-101592370-A (Year: 2019).*
English Translation of Yuefeng CN-101592370A (Year: 2019).*
English Translation of Hui CN-103759344-A (Year: 2019).*

*Primary Examiner* — Elizabeth J Martin
(74) *Attorney, Agent, or Firm* — The Webb Law Firm

(57) ABSTRACT

The present disclosure relates to an air-conditioning outdoor device and an air conditioner unit. The air-conditioning outdoor device comprises: an outdoor unit housing; a primary air return port and an air outlet port provided on a front panel on a side of the outdoor unit housing away from an installation wall; and a supplementary air return port pro-
(Continued)

vided on a side panel of the outdoor unit housing adjacent to the front panel; wherein the primary air return port and the supplementary air return port both communicate with an air return chamber inside the outdoor unit housing. The air-conditioning outdoor device of the present disclosure can effectively increase the air flow volume through the air port of the air-conditioning outdoor device.

16 Claims, 4 Drawing Sheets

(51) Int. Cl.

| | |
|---|---|
| ***F24F 1/38*** | (2011.01) |
| ***F24F 1/16*** | (2011.01) |
| ***F24F 1/40*** | (2011.01) |

(56) References Cited

U.S. PATENT DOCUMENTS

| | | | | | |
|---|---|---|---|---|---|
| 5,197,299 | A * | 3/1993 | Sohn | F24F 1/027 | 312/101 |
| 2004/0163408 | A1* | 8/2004 | Kim | F25D 23/003 | 62/428 |
| 2005/0056037 | A1* | 3/2005 | Park | F24F 13/20 | 62/262 |
| 2005/0274135 | A1* | 12/2005 | Kim | F24F 13/20 | 62/262 |
| 2011/0120155 | A1* | 5/2011 | Lingrey | F24F 1/027 | 62/89 |
| 2013/0199237 | A1* | 8/2013 | Kim | F25B 1/00 | 62/467 |
| 2014/0298844 | A1* | 10/2014 | Luo | F24F 1/36 | 62/275 |
| 2015/0007605 | A1* | 1/2015 | Masui | F25B 39/00 | 62/508 |

FOREIGN PATENT DOCUMENTS

| | | | | |
|---|---|---|---|---|
| CN | 100523628 | C | | 8/2009 |
| CN | 101592370 | A | * | 12/2009 |
| CN | 101592370 | A | | 12/2009 |
| CN | 203100011 | U | | 7/2013 |
| CN | 103759344 | A | * | 4/2014 |
| CN | 103759344 | A | | 4/2014 |
| CN | 206531159 | U | | 9/2017 |
| CN | 207815533 | U | | 9/2018 |
| KR | 1020070078662 | A | | 8/2007 |
| KR | 1020070095575 | A | | 10/2007 |

* cited by examiner

AIR-CONDITIONING OUTDOOR DEVICE AND AIR CONDITIONER UNIT

CROSS-REFERENCE TO RELATED APPLICATIONS

This application is the United States national phase of International Application No. PCT/CN2018/078421 filed. Mar. 8, 2018, and claims priority Chinese Patent Application No. 201711431265.7 filed Dec. 26, 2017, the disclosures of which are hereby incorporated in their entirety by reference.

This application is based on and claims the priority of a Chinese application No. 201711431265.7, filed on Dec. 26, 2017, the contents of which are hereby incorporated by reference in their entirety.

BACKGROUND OF THE INVENTION

Field of the Invention

The present disclosure relates to the field of air conditioning, and in particular to an air-conditioning outdoor device and an air conditioner unit.

Description of Related Art

In the related art, air-conditioning outdoor devices (e.g. the air-conditioning outdoor device for household multi-connected units) are mostly installed at an air conditioner installation location that is preset on the outside of the wall of a building, on the building roof or the like. When the outside of the wall is free from or cannot be provided with the air conditioner installation location and the desired air conditioner installation location is relatively far from the building roof, the air-conditioning outdoor device is very difficult to install. Further, as restricted by safety requirements, it is not allowed to install the air-conditioning outdoor device on the outside of the wall of a residential building and the air conditioner installation location shall not be provided in some countries and regions (such as Northern America, etc.), making it difficult for some existing air-conditioning outdoor devices to be used in these countries and regions.

In order to simplify installation of the air-conditioning outdoor device and meet the specific safety requirements, an installation scheme of opening a hole in the wall of the building for embedded installation of the air-conditioning outdoor device occurs in the related art. Although such scheme satisfies the specific safety requirements to some extent, the air flow volume through the air port of the air-conditioning outdoor device embedded in the wall hole is affected as the dimension of the air port is limited by the dimension of the wall hole, and accordingly the performance of the air-conditioning outdoor device is restricted.

SUMMARY OF THE INVENTION

In view of this, an air-conditioning outdoor device and an air conditioner unit are provided in embodiments of the present disclosure, which can improve the air flow volume through the air port of the air-conditioning outdoor device.

According to an aspect of the present disclosure, an air-conditioning outdoor device is provided, comprising: an outdoor unit housing: a primary air return port and an air outlet port provided on a front panel on a side of the outdoor unit housing away from an installation wall; and a supplementary air return port provided on a side panel of the outdoor unit housing between the front panel and the installation wall; wherein the primary air return port and the supplementary air return port both communicate with an air return chamber inside the outdoor unit housing.

In some embodiments, the primary air return port is located on a side of the front panel adjacent to the supplementary air return port.

In some embodiments, the front panel is provided with two groups of the primary air return ports, and the air outlet port is located between the two groups of the primary air return ports.

In some embodiments, two of the side panels on the outdoor unit housing are each provided with the supplementary air return port, and the two groups of the primary air return ports are located on two sides of the front panel adjacent to the supplementary air return port respectively.

In some embodiments, a length direction of the supplementary air return port is parallel to the front panel.

In some embodiments, further comprising a fan system and a heat exchanger sequentially arranged in an internal air duct from the air return chamber to the air outlet port inside the outdoor unit housing.

In some embodiments, further comprising: a partition plate arranged inside the outdoor unit housing and separating at least two independent spaces inside the outdoor unit housing; and a heat exchanger and a fan system both arranged in one of the at least two independent spaces.

In some embodiments, the one of the at least two independent spaces is located at a side in the outdoor unit housing adjacent to the front panel.

In some embodiments, further comprising at least one of a compressor, a pipeline system and an electrical box, the at least one of a compressor, a pipeline system and an electrical box is arranged in another one of the at least two independent spaces inside the outdoor unit housing.

In some embodiments, the another one is located at a side in the outdoor unit housing away from the front panel.

In some embodiments, the heat exchanger comprises a U-shaped plate heat exchange structure, the fan system is located in a recessed area of the plate heat exchange structure, the air return chamber is located outside the plate heat exchange structure, and the air outlet port is located at a position on the front panel corresponding to the air outlet side of the fan system.

In some embodiments, the another one is further provided with a soundproof structure or a soundproof material on an inner or outer side thereof.

In some embodiments, a length of the outdoor unit housing in a horizontal direction is greater than a height thereof in a vertical direction.

In some embodiments, the outdoor unit housing for being embedded in a wall hole provided in the installation wall, the front panel and a portion of the side panel protrude outwards relative to the installation wall, and at least part of the supplementary air return port is located outside the installation wall.

In some embodiments, the air-conditioning outdoor device further comprises a support frame, the wall hole is a linear through hole that communicates an outdoor side with an indoor side of the installation wall, and an exposed portion of the outdoor unit housing at a side indoor is supported and fixed by the support frame.

In some embodiments, further comprising a valve for connection with an air-conditioning indoor unit, and the valve is disposed on the side panel through a valve bracket.

According to another aspect of the present disclosure, an air conditioner unit is provided, comprising the aforementioned air-conditioning outdoor device.

Therefore, according to the embodiments of the present disclosure, the front panel and the side panel of the air-conditioning outdoor device are provided with the primary air return port and the supplementary air return port respectively, and the primary air return port and the air outlet port are both provided on the front panel. In this way, when the air-conditioning outdoor device is embedded in the wall hole, air exhaust and air return can be achieved by full use of the front panel with a large size, and air return volume can be increased by using the supplementary air return port on the side panel to assist the primary air return port, thereby effectively increasing the air flow volume through the air port of the air-conditioning outdoor device.

BRIEF DESCRIPTION OF THE DRAWINGS

Drawings explained here are used to provide further understanding of the present disclosure, which constitute a portion of the present application. The schematic embodiments and description thereof of the present disclosure are used for explaining the present disclosure, and do not constitute improper delimitations of the present disclosure. In the drawings.

DESCRIPTION OF THE INVENTION

Figure 1:
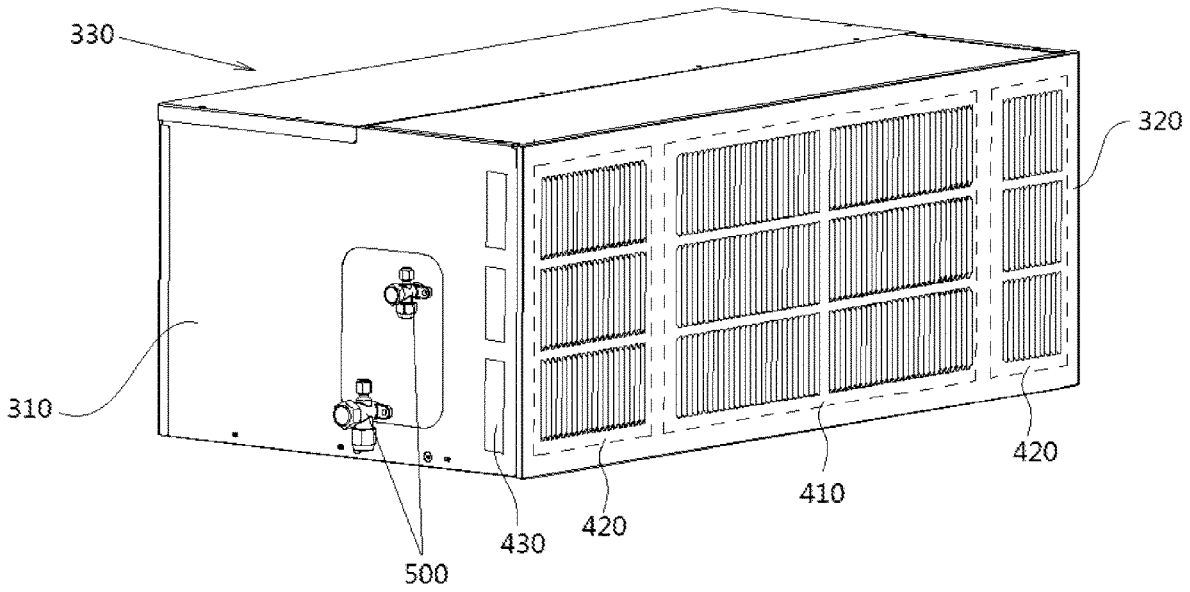
FIG. 1 shows an exemplary structure view of an air-conditioning outdoor device in some embodiments of the present disclosure.

The technical solutions in the embodiments of the present disclosure will be described clearly and completely with reference to the accompanying drawings in the embodiments of the present disclosure. Apparently, the described embodiments are merely part of the embodiments of the present disclosure, rather than all the embodiments. The following descriptions of at least one exemplary embodiment which are in fact merely descriptive, by no means serve as any delimitation on the present disclosure as well as its application or use. On the basis of the embodiments in the present disclosure, all the other embodiments acquired by a person skilled in the art on the premise that no inventive effort is involved fall into the protection scope of the present disclosure.

The terms such as "first" and "second" recited in the present disclosure are only for the convenience of description, so as to distinguish different constituent parts having the same term rather than presenting a sequential or dominant relation. In the description of the present disclosure, it is necessary to understand that, the azimuth or positional relations indicated by the terms "length", "width", "thickness" and the like, which are shown based on the drawings, are only for facilitating description of the present disclosure, rather than indicating or implying that the device referred to has to present a particular azimuth, and be constructed and operated in a particular azimuth, so that it cannot be understood as limiting the protection scope of the present disclosure.

Unless additionally specified, the relative arrangements, numerical expressions and numerical values of the components and steps expounded in these examples do not limit the scope of the present disclosure. At the same time, it should be understood that, in order to facilitate the description, the dimensions of various parts shown in the drawings are not delineated according to actual proportional relations. The techniques, methods, and apparatuses known to a common technical person in the relevant art may not be discussed in detail, but where appropriate, said techniques, methods, and apparatuses should be considered as part of the granted description. Among all the examples shown and discussed here, any specific value should be construed as being merely illustrative, rather than as delimitation. Thus, other examples of exemplary embodiments may have different values. It should be noted that similar reference signs and letters present similar items in the following drawings, and therefore, once an item is defined in a drawing, there is no need for further discussion in the subsequent drawings.

Figure 3:
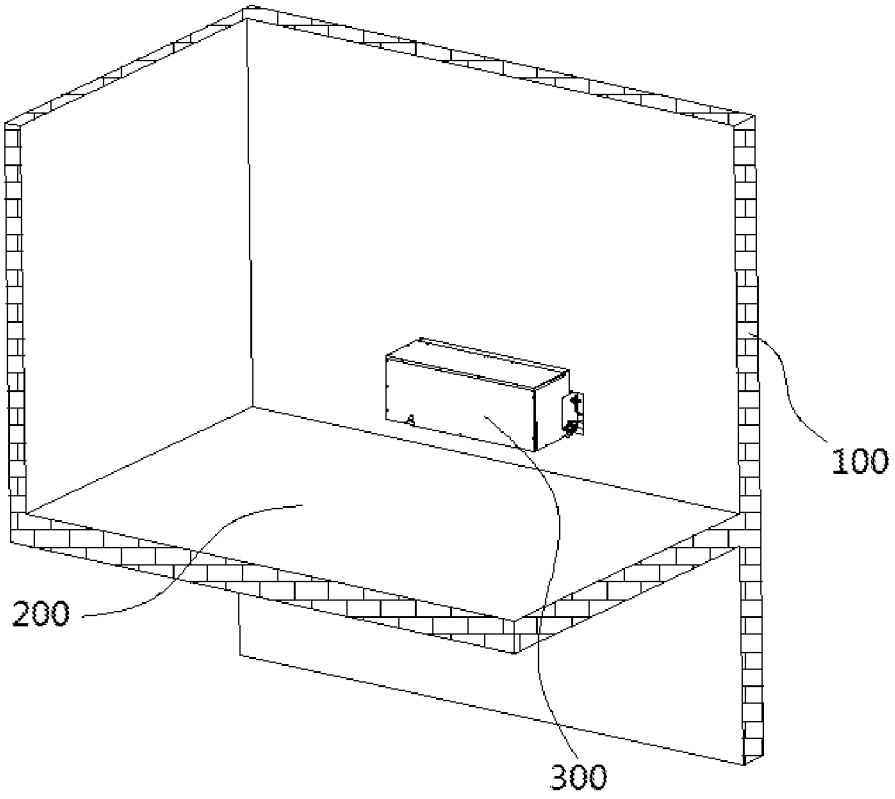
FIGS. 3 and 4 show an exemplary structure view of the air-conditioning outdoor device after installation observed from indoor side view and from outdoor side view respectively in the embodiments of the present disclosure.
Figure 4:
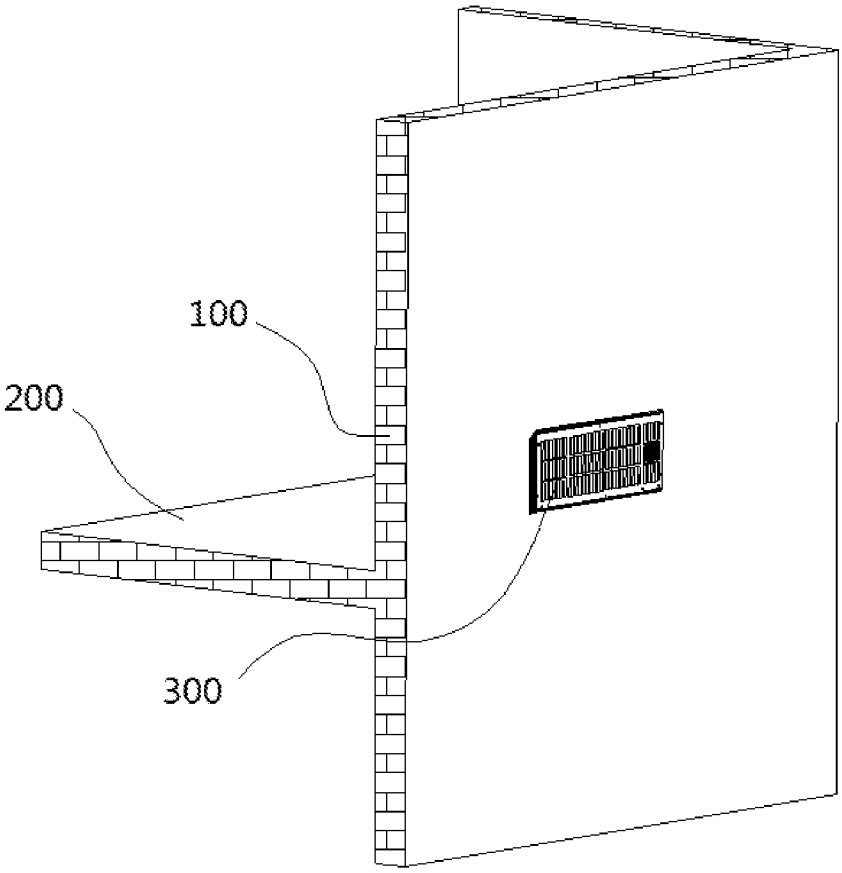

As shown, FIG. 1 shows an exemplary structure view of an air-conditioning outdoor device in some embodiments of the present disclosure. FIGS. 3 and 4 show an exemplary structure view of the air-conditioning outdoor device after installation observed from indoor side view and from outdoor side view respectively in the embodiments of the present disclosure.

Referring to FIGS. 1, 3 and 4, the air-conditioning outdoor device in some embodiments comprises an outdoor unit housing 300. The outdoor unit housing 300 may be installed in such a manner as to be embedded in an installation wall 100 with reference to FIGS. 3 and 4. That is, a wall hole matching an outline dimension of the outdoor unit housing 300 may be reserved or opened in the installation wall 100.

When there is a need for installation of the air-conditioning outdoor device, the outdoor unit housing 300 is embedded in the wall hole while making a front side structure of the air-conditioning outdoor device (a direction pointing to the outdoor from the indoor is regarded as a forward direction) located at the outdoor side, and the support action on the outdoor unit housing 300 is achieved by thickness of the wall hole. For the wall hole in the form of a through hole, after installation of the air-conditioning outdoor device, a rear side structure of the outdoor unit housing 300 is located at the indoor side as shown in FIG. 3. While in some other embodiments, when the air-conditioning outdoor device is embedded in the wall hole in the form of a blind hole provided in the wall 100, the indoor side may not communicate with the wall hole.

Referring to FIG. 1, with the direction pointing to the outdoor from the indoor being taken as a forward direction, a front panel 320 on a side of the outdoor unit housing 300 away from the installation wall 100 may be provided with a primary air return port 420 and an air outlet port 410. A side panel 310 of the outdoor unit housing 300 between the front panel 320 and the installation wall 100 is further provided with a supplementary air return port 430. The primary air return port 420 and the supplementary air return port 430 both communicate with an air return chamber inside the outdoor unit housing 300. In this way, when the air-conditioning outdoor device is embedded in the wall hole, air exhaust and air return can be achieved by full use of the front panel with a large size, and air return volume can be increased by using the supplementary air return port on the side panel to assist the primary air return port, thereby effectively increasing the air flow volume through the air port of the air-conditioning outdoor device.

In order to enable the supplementary air return port 430 to achieve air return smoothly, the front panel 320 and a portion of the side panel 310 of the outdoor unit housing 300 may optionally be protruded outwards relative to the installation wall 100, and at least part of the supplementary air return port 430 may be located outside the installation wall 100. In this way, the blocking effect on the supplementary air return port 430 by the installation wall 100 is reduced, and the air return volume is increased.

In other embodiments, the outdoor unit housing 300 may also be embedded in a wider wall hole so that the supplementary air return port 430 can return air through a passage formed by a gap between the outdoor unit housing 300 and the wall hole. Thus, it is allowed that the front panel 320 of the outdoor unit housing 300 is installed in a manner of not protruding from the surface of the outer wall, to thereby meet the policy requirement in some specific regions (for example, in Northern America countries, etc.) that the outside of the wall shall not be provided with the air-conditioning outdoor device.

On the front panel 320, the primary air return port 420 may optionally be located on a side of the front panel 320 adjacent to the supplementary air return port 430 so that the primary air return port 420 and the supplementary air return port 430 can communicate with the air return chamber more closely. Referring to FIG. 1, the front panel 320 may be provided with two groups of the primary air return ports 420, and the air outlet port 410 is disposed between the two groups of the primary air return ports 420. Correspondingly, two of the side panels 310 on the outdoor unit housing 300 may each be provided with the supplementary air return port 430. The two groups of the primary air return ports 420 are located on two sides of the front panel 320 adjacent to a respective supplementary air return port 430. In this way, both sides of the front panel 320 and the adjacent side panels of the outdoor unit housing 300 can achieve the air return function, while the middle part of the front panel 320 can achieve the air exhaust function. The rational zoning of the air return function and the air exhaust function can shorten the internal flow field to reduce the pressure loss of the air flow in the internal flow field, and also makes the internal flow field more uniform to thereby improve the heat transfer efficiency.

When the supplementary air return port 430 is provided, a length direction of the supplementary air return port 430 may optionally be parallel to the front panel 320. In this way, when the outdoor unit housing 300 is embedded in the wall hole, a portion of the side panel 310 protruding outwards relative to the outer wall to expose the supplementary air return ports 430 can be reduced in size.

When the air-conditioning outdoor device is installed on the wall 100, compared with the related art in which the air outlet port and the air inlet port are arranged vertically, in some embodiments of the present disclosure, the outdoor unit housing 300 is configured such that its length in a horizontal direction is greater than its height in a vertical direction. That is, the outdoor unit housing 300 is configured as a shape of a flat box, the dimension of which in a left-and-right direction is greater than the dimension of which in an up-and-down direction, so as to increase the lateral support area of the outdoor unit housing 300 by the wall 100, thereby improve the installation stability of the air-conditioning outdoor device and decrease the requirement for supporting ability of the wall 100, and this also facilitates simplification of the installation by reduction of the auxiliary support.

In FIG. 3, the wall hole is a linear through hole that communicates the outdoor side with the indoor side of the installation wall 100. The portion of the air-conditioning outdoor device exposed at the indoor side can be kept at a certain height from a floor 200. If the thickness of the installation wall 100 is large, the air-conditioning outdoor device may be mainly supported through the wall hole. However, if the thickness of the installation wall 100 is limited, apart from use of the wall hole for support, in some other embodiments, the air-conditioning outdoor device may further include a support frame, and the exposed portion of the outdoor unit housing 300 at an indoor side of the installation wall can be supported and fixed by the support frame.

Referring to FIG. 1, in some embodiments, the air-conditioning outdoor device may further include a valve 500 for connection with an air-conditioning indoor unit. The valve 500 may be disposed on the side panel 310 of the outdoor unit housing 300 through a valve bracket 510. After the air-conditioning outdoor device is installed on the installation wall 100, the valve 500 and part of the connection pipelines to the air-conditioning indoor unit are also located in the wall hole of the installation wall 100. The valve 500 and the connection pipelines may be hidden in the wall hole by means of providing a baffle or the like to avoid being exposed indoor, which is not only conducive to protection, but also conducive to maintaining a beautiful interior environment.

Figure 2:
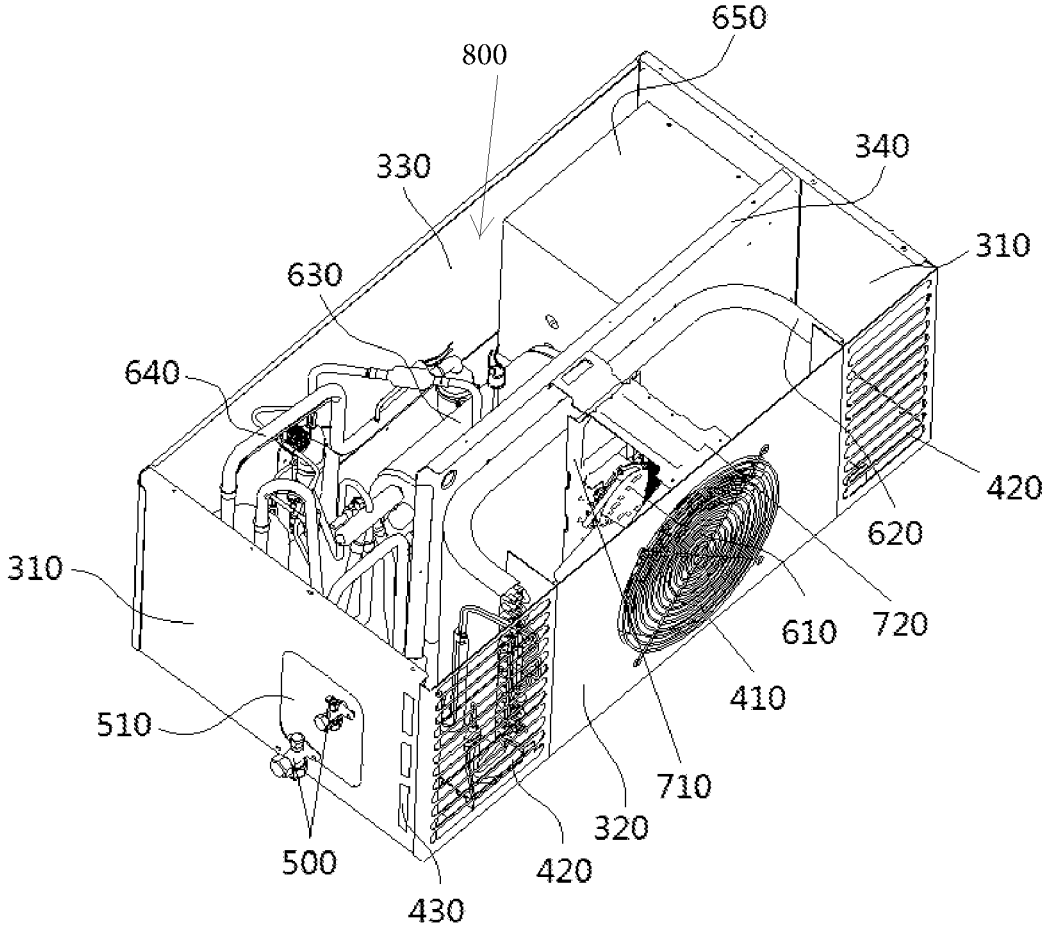
FIG. 2 shows an exemplary structure view of the air-conditioning outdoor device with a top cover omitted in other embodiments of the present disclosure.

As shown in FIG. 2, it shows an exemplary structure view of the air-conditioning outdoor device with a top cover omitted in some other embodiments of the present disclosure. In present embodiments, the air-conditioning outdoor device further comprises: a fan system 610 and a heat exchanger 620 sequentially arranged in an internal air duct from the air return chamber to the air outlet port 410 inside the outdoor unit housing 300. Such blow-type heat exchange means can allow the outdoor air to enter the air return chamber inside the outdoor unit housing 300 through the primary air return port 420 and the supplementary air return port 430, then be blown towards the heat exchanger 620 by the fan system 610 to exchange heat with the heat exchanger 620, and finally be discharged outdoors through the air outlet port 410.

Referring to FIG. 2, in some embodiments, the air-conditioning outdoor device may further include a partition plate 340, a heat exchanger 620 and a fan system 610. The partition plate 340 is arranged inside the outdoor unit housing 300 and separates at least two independent spaces inside the outdoor unit housing 300. The fan system 610 and the heat exchanger 620 are both arranged in one of the at least two independent spaces (e.g. a first independent space).

By arranging the fan system 610 and the heat exchanger 620 in the same independent space, the air return and air exhaust of the air-conditioning outdoor device is not prone to be affected by other components inside the outdoor unit housing 300, thereby making the air flow field smoother to improve the heat transfer effect. The independent space where the fan system 610 and the heat exchanger 620 are arranged, may optionally be located at a side in the outdoor unit housing 300 adjacent to the front panel 320 to facilitate circulation with the outdoor air.

In FIG. 2, a compressor 630, a pipeline system 640 and/or an electrical box 650 may further be comprised in the air-conditioning outdoor device. The compressor 630, the pipeline system 640 and/or the electrical box 650 may optionally be provided in another independent space (e.g. a second independent space) inside the outdoor unit housing 300 so as to make the internal structures of the air-conditioning outdoor device more orderly and compact. The another independent space where the compressor 630, the pipeline system 640 and/or the electrical box 650 are arranged, may optionally be located at a side in the outdoor unit housing 300 away from the front panel 320, e.g. at the indoor side, so that an operator can conveniently perform wiring, installation and maintenance to the air conditioner unit at the indoor side after opening a rear panel 330. Furthermore, the another independent space where the compressor 630, the pipeline system 640 and/or the electrical box 650 are arranged, may further be provided with a noise limiting structure (a soundproof structure) 800 so as to decrease the effect of the air-conditioning outdoor device on the indoor side during operation, and make the air conditioner unit less noisy and more comfortable to use.

Referring to FIG. 2, in some embodiments, the heat exchanger 620 may comprise a U-shaped plate heat exchange structure, and the fan system 610 is disposed in a recessed area of the plate heat exchange structure. This can save the space occupied by the heat exchanger 620 and the fan system 610. The air return chamber is located outside the plate heat exchange structure, and the air outlet port 410 is provided at a position on the front panel 320 corresponding to the air outlet side of the fan system 610. The top end of the front panel 320 and the top end of the partition plate 340 may further be connected by a connecting plate 720 in a fore-and-aft direction. There is a fan bracket 710 fixed between the connecting plate 720 and a bottom plate, and the fan system 610 is arranged on the fan bracket 710. In present embodiments, the fan system 610 uses an axial flow fan. In other embodiments, the fan system 610 also uses fans with other structures, such as a centrifugal fan, a cross flow fan, etc.

The above embodiments of the air-conditioning outdoor device may be applied to air conditioner units. Correspondingly, there is also provided an air conditioner unit comprising the air-conditioning outdoor device in any one of the aforementioned embodiments, so as to increase the air flow volume through the air port of the air-conditioning outdoor device.

Finally, it should be explained that the aforementioned embodiments are only used to describe the technical solution of the present disclosure rather than limiting the same; although detailed explanations are made to the present disclosure by referring to preferred embodiments, a common technical person in the art should understand that: it is still possible to make amendments to the embodiments of the present disclosure or make equivalent replacements to part of the technical features; without departing from the spirit and scope of the present disclosure, they should all be covered in the scope of the technical solution for which protection is sought in the present disclosure.

What is claimed is:

1. An air-conditioning outdoor device, comprising:

an outdoor unit housing;

a primary air return port and an air outlet port provided on a front panel on a side of the outdoor unit housing away from an installation wall, wherein a direction pointing to the outdoor from the indoor is taken as a forward direction; and a supplementary air return port provided on a side panel of the outdoor unit housing adjacent to the front panel, configured to communicate inside of the outdoor unit housing with outside of the outdoor unit housing;

wherein the primary air return port and the supplementary air return port both communicate with an air return chamber inside the outdoor unit housing, the outdoor unit housing is configured to be embedded in a wall hole provided in the installation wall, the front panel and a portion of the side panel protrude outwards relative to the installation wall, and at least part of the supplementary air return port is located outside the installation wall.

2. The air-conditioning outdoor device according to claim 1, wherein the primary air return port is located on a side of the front panel adjacent to the supplementary air return port.

3. The air-conditioning outdoor device according to claim 1, wherein the front panel is provided with two groups of primary air return ports, and the air outlet port is located between the two groups of primary air return ports.

4. The air-conditioning outdoor device according to claim 3, wherein two side panels on the outdoor unit housing are each provided with the supplementary air return port, and the two groups of primary air return ports are located on two sides of the front panel adjacent to a respective supplementary air return port.

5. The air-conditioning outdoor device according to claim 1, wherein a length direction of the supplementary air return port is parallel to the front panel.

6. The air-conditioning outdoor device according to claim 1, further comprising a fan system and a heat exchanger sequentially arranged in an internal air duct from the air return chamber to the air outlet port inside the outdoor unit housing.

7. The air-conditioning outdoor device according to claim 6, wherein the heat exchanger comprises a U-shaped plate heat exchange structure, the fan system is located in a recessed area of the plate heat exchange structure, the air return chamber is located outside the plate heat exchange structure, and the air outlet port is located at a position on the front panel corresponding to an air outlet side of the fan system.

8. The air-conditioning outdoor device according to claim 1, further comprising:

a partition plate arranged inside the outdoor unit housing and separating at least two independent spaces inside the outdoor unit housing; and a heat exchanger and a fan system both arranged in one of the at least two independent spaces.

9. The air-conditioning outdoor device according to claim 8, wherein the one of the at least two independent spaces is located at a side in the outdoor unit housing adjacent to the front panel.

10. The air-conditioning outdoor device according to claim 8, further comprising at least one of a compressor, a pipeline system and an electrical box, wherein at least one of the compressor, the pipeline system and the electrical box is arranged in another one of the at least two independent spaces inside the outdoor unit housing.

11. The air-conditioning outdoor device according to claim 10, wherein the another one of the at least two independent spaces is located at a side in the outdoor unit housing away from the front panel.

12. The air-conditioning outdoor device according to claim 10, wherein the another one of the at least two independent spaces is provided with a noise limiting structure.

13. The air-conditioning outdoor device according to claim 1, wherein a length of the outdoor unit housing in a horizontal direction is greater than a height thereof in a vertical direction.

14. The air-conditioning outdoor device according to claim 1, further comprising a support frame, wherein the wall hole is a linear through hole that communicates an outdoor side with an indoor side of the installation wall, and an exposed portion of the outdoor unit housing at an indoor side of the installation wall is supported and fixed by the support frame.

15. The air-conditioning outdoor device according to claim 1, further comprising a valve for connection with an air-conditioning indoor unit, wherein the valve is disposed on the side panel through a valve bracket.

16. An air conditioner unit comprising the air-conditioning outdoor device according to claim 1.

* * * * *